US005224914A

United States Patent [19]

Friedman

[11] Patent Number: 5,224,914

[45] Date of Patent: Jul. 6, 1993

[54] ABDOMINAL EXERCISE DEVICE

[76] Inventor: Andrew M. Friedman, 7096 S. Palo Verde Way, #V21, Salt Lake City, Utah 84121

[21] Appl. No.: 948,424

[22] Filed: Sep. 22, 1992

[51] Int. Cl.[5] ..... A63B 21/045; A63B 71/00

[52] U.S. Cl. ..... 482/127; 482/140

[58] Field of Search ..... 482/121, 127, 140, 124, 482/131, 133, 122, 125, 126; 128/78; 602/19

[56] References Cited

U.S. PATENT DOCUMENTS

| | | | |
|---|---|---|---|
| 3,814,419 | 6/1974 | Bjorklund et al. | 482/124 |
| 4,039,183 | 8/1977 | Sakurada | 482/127 |
| 4,314,697 | 2/1982 | Brumfield et al. | 272/136 |
| 4,603,858 | 8/1986 | Reehil | 272/137 |
| 4,775,148 | 10/1988 | McLaughlin | 272/139 |
| 4,807,873 | 2/1989 | Naquin | 272/93 |
| 5,007,632 | 4/1991 | Wilkinson | 272/72 |
| 5,031,906 | 7/1991 | Jang | 272/137 |
| 5,176,622 | 1/1993 | Anderson et al. | 482/127 |

*Primary Examiner*—Stephen R. Crow
*Attorney, Agent, or Firm*—Richard C. Litman

[57] ABSTRACT

A portable exercise device for exercising muscles in the abdomen and torso formed of a pair of upper legs and a pair of lower legs connected by a resilient device effective to resist pressure applied by a user to superimpose the respective upper and lower legs, the upper legs being connected to a transverse bar selectively supporting handles or pads and including a centrally located recessed portion. The lower legs are connected to a transverse board which may have padding to ease engagement with a user's legs. The resilient device selectively includes torsion springs, hydraulic cylinders, resilient rubberlike material, and plates formed of spring steel. In one embodiment the transverse bar and transverse board are each formed of longitudinal molded plastic halves having internal strengthening ribs, and grooves to clamp the upper and lower legs between the halves when the halves are secured together in clam shell-like fashion. Alternatively, the transverse bar and board are formed of plastic with the upper and lower legs embedded in the plastic. In still another embodiment transverse bar and board are omitted and the upper and lower legs are encased in soft foam rubber. The torsion springs, upper legs, lower legs, and a connecting portion between said lower legs may be integrally formed from spring steel.

22 Claims, 12 Drawing Sheets

ABDOMINAL EXERCISE DEVICE

BACKGROUND OF THE INVENTION

1. Field Of The Invention

This invention relates to a portable abdominal exercising device that provides bending resistance which exercises the muscles in the abdomen and torso area when the user attempts to move opposing legs of the device to a closed position. While the principle use of the invention is to exercise the abdominal muscles, the device may also be used to exercise other parts of the body such as the arms or chest.

2. Description Of The Related Prior Art

Exercise devices for exercising abdominal muscles are known in the prior art. U.S. Pat. No. 4,314,697 issued Feb. 9, 1982 to Maxine L. Brumfield et al. discloses a physical exercising device which comprises a wedge shaped base and a spring biased exercise bar which is pivotally mounted near the apex of the base. In use the individual places his or her legs over the apex of the base and manipulates the exercise bar in a rowing motion against the bias of a pair of tension springs.

U.S. Pat. No. 4,603,858 issued Aug. 5, 1986 to Edward J. Reehil discloses an abdominal exerciser comprising an upper tube and a lower tube which are pivotally aligned and held in a coplanar position by a torsion spring. Operation of the exerciser requires the provision of a belt in order to hold the exerciser in position adjacent the body of the user.

U.S. Pat. No. 4,775,148 issued Oct. 4, 1988 to Gary G. McLaughlin discloses an abdominal exerciser comprising a contacting plate, a retainer plate, a compression spring located between the plates, and a belt to hold the exerciser in place on the abdomen. The user alternately tightens the abdominal muscles to push the contacting plate toward the retainer plate to compress the spring, and then relaxes the abdominal muscles allowing the spring to push the retainer plate and the contacting plate apart.

U.S. Pat. No. 4,807,873 issued Feb. 28, 1989 to Charles E. Naquin discloses an abdominal exercise apparatus and method comprising a V-shaped frame which mounts three transverse cross-bars, one cross-bar being located at the apex of the V, and the other two being located at the ends of the legs of the V shaped frame. In use the individual places one cross-bar beneath his or her ankles, a second cross-bar above the thigh near the knee, and the third cross-bar beneath the thigh near the hips. The individual exercises by lifting the frame by his or her legs.

U.S. Pat. No. 5,007,632 issued Apr. 16, 1991 to William T. Wilkinson discloses a combination sit-up, rowing, arm, leg and foot exercise device comprising a center pole, a seat attached to the center pole, a foot cross pole and a plurality of tension springs. The user exercises by pulling against the tension of the springs.

U.S. Pat. No. 5,031,906 issued Jul. 16, 1991 to Sreter Jang discloses an exercising machine comprising a pair of handles connected by a compression links and elastic cords whereby the apparatus may be used as a pulling machine, a chest expander, a compression device, an abdomen exercising machine, a device for push-ups exercise or a device for exercising the lower extremity.

SUMMARY AND OBJECTS OF THE INVENTION

None of the above-cited patents disclose or suggest alone or in combination the instant invention described and claimed herein. The instant invention comprises a pair of torsion springs each spring having a vertical leg and a horizontal leg, the vertical legs being connected to a transverse bar located approximately at the shoulder level of a user, and the horizontal legs being connected to a horizontal board designed to rest across the upper legs of the user. The horizontal board is padded on its base for leg comfort. The transverse bar may be provided with handles, or alternatively with padded contact points. In a first embodiment the torsion springs are formed from a single, unitary spring stock material shaped to provide the vertical and horizontal legs, with the horizontal legs being connected by a portion of the spring stock material mounted along the length of the horizontal board.

In a second embodiment the pair of springs are formed of flat spring steel designed to flex when pressure is brought to bear on the vertical bar and horizontal board.

In a third embodiment, the legs equivalent to the torsion spring legs are pivoted at their apex, with resistance being provided by a pair of pneumatic or fluid filled cylinders.

In a fourth embodiment, resistance is provided by rubber or other elastomer substituted for the coils forming the torsion springs of the first embodiment.

In a fifth embodiment, the vertical and horizontal torsion spring legs are encased in molded foam rubber padding, with the vertical torsion spring legs bent toward each at a 90° degree angle to form handles. The transverse bar and horizontal leg board are omitted in this embodiment.

In a sixth embodiment, which is the preferred embodiment of this invention, the transverse bar and the horizontal leg board are each formed of two longitudinal halves of molded plastic material, each half having strengthening ribs, and grooves for receiving the vertical and horizontal torsion spring legs. The respective halves are joined together in a clam shell fashion by bolts and nuts received in recessed bores. The handles are integrally molded with the half of the transverse bar facing the user.

In a seventh embodiment, the vertical and horizontal torsion spring legs are insert molded into a unitary plastic transverse bar and a unitary plastic horizontal board. The horizontal board has a rubber pad on the lower surface for resting on a user's legs. In this embodiment the handles are bolted to the transverse bar by bolts and nuts located in recessed bores.

If it is found to be desirable a belt may be threaded through the coils of the torsion springs whereby the exercise device may be connected to the user. Also, a cover may be mounted over the coiled portion of the torsion springs to improve the appearance thereof.

Accordingly, it is an object of this invention to provide an abdominal exercise device which is portable and easy to use.

It is a further object of this invention to provide an abdominal exercise device which is economical to manufacture.

It is another object of this invention to provide and abdominal exercise device which may be used in a sitting position in a chair, or while sitting on the floor.

It is a still further object of this invention to provide an abdominal exercise device which may be used with or without a restraining belt.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
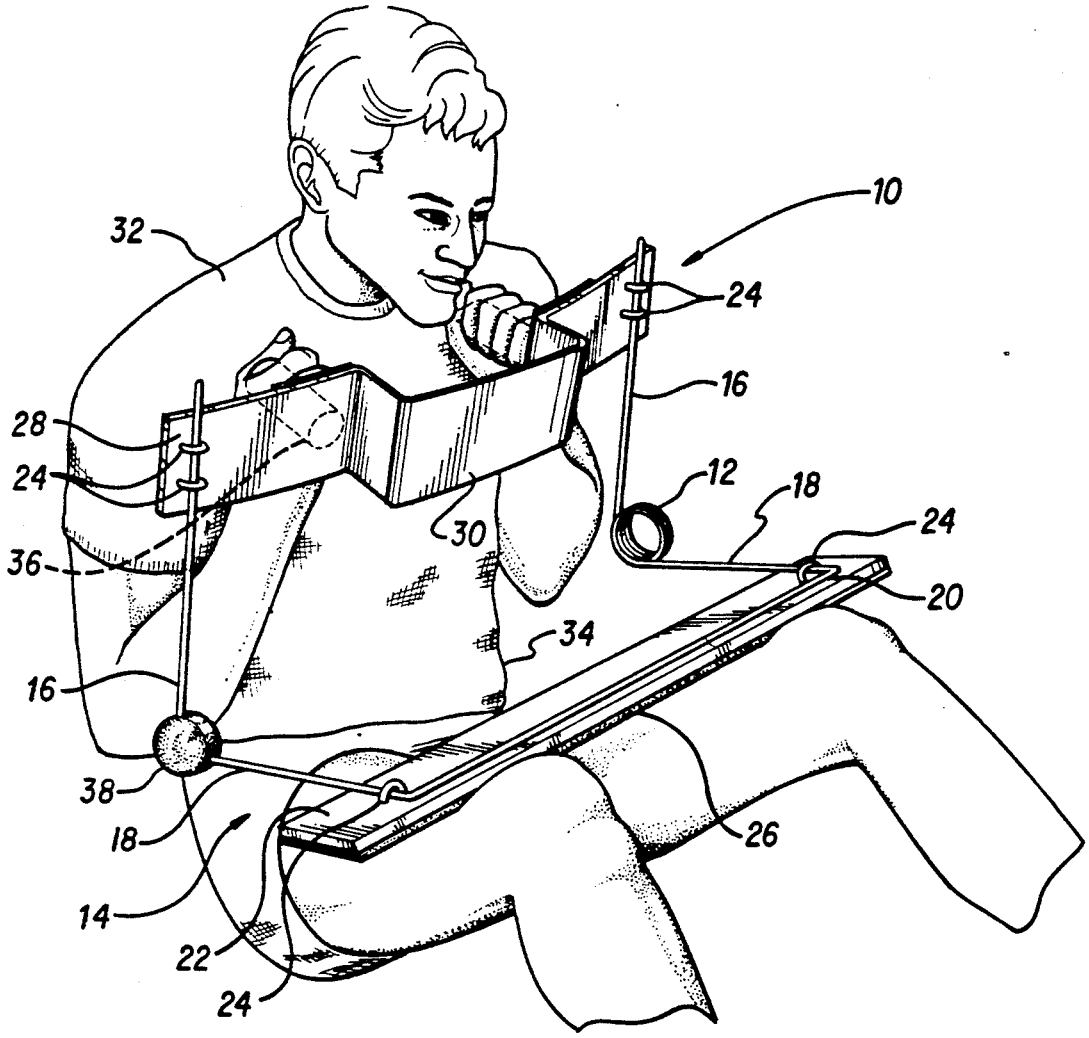
FIG. 1 is an environmental perspective view of the abdominal exercise device showing how the device is used.

FIG. 1 Shows the abdominal exercise device 10 in use. Device 10 comprises a pair of torsion springs 12 formed of a single, integral piece of spring stock material 14 so as to provide vertical legs 16 and horizontal legs 18 connected by an integral portion 20 of spring stock material 14. Horizontal legs 18 and the integral connecting portion 20 are suitably mounted on a leg engaging board 22, as by U-clips or staples 24 as shown. The leg engaging board 22 is preferably provided with padding 26.

Vertical legs 16 are connected to a transverse bar 28 of plastic or sheet metal and configured to have a recessed portion 30 to enable the user 32 to lean forward without interference with the upper body or torso 34. Bar 28 is provided with a pair of handles 36. The torsion springs 12 may be provided with covers such as cover 38.

Figure 2:
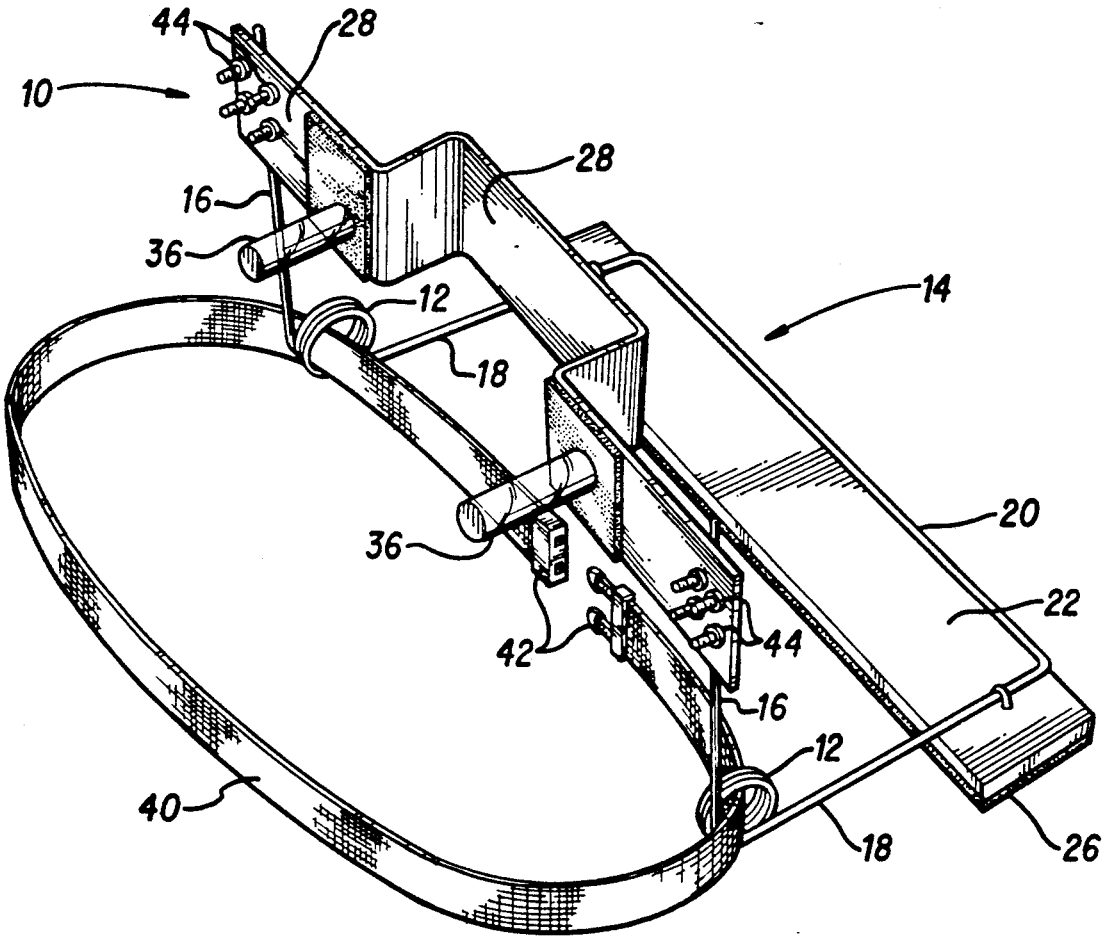
FIG. 2 is a perspective view showing a first embodiment of the abdominal exercise device.

As shown in FIG. 2 a belt 40 having any suitable closure apparatus 42 may be threaded through the eyes of torsion springs 12 whereby the abdominal exercise device may be attached to the waist of user 32 if found to be desirable. Also shown are handles 36, and nuts 44 connected to threaded ends of U-clips or staples 24 to enable disassembly of the exercise device 10 to simplify storage or the replacement of parts.

Figure 3:
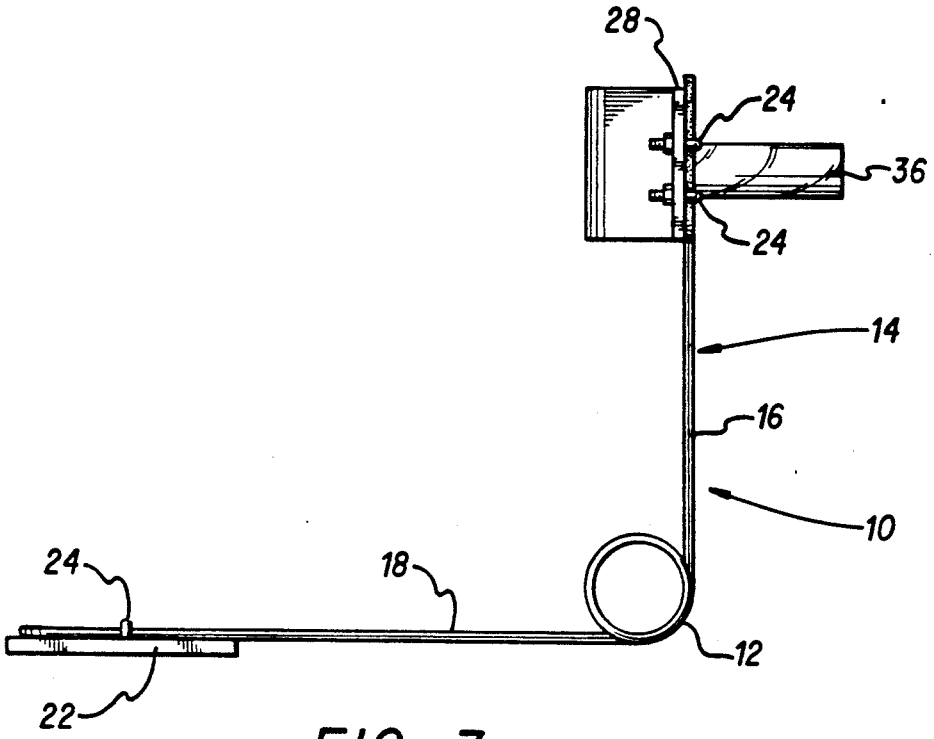
FIG. 3 is a side view of the first embodiment of the abdominal exercise device.

FIG. 3 provides a side view of abdominal exercise device 10. While legs 16 and 18 are shown as forming a right angle in the relaxed condition, other angles may be selected depending on the degree of resistance desired.

Figure 4:
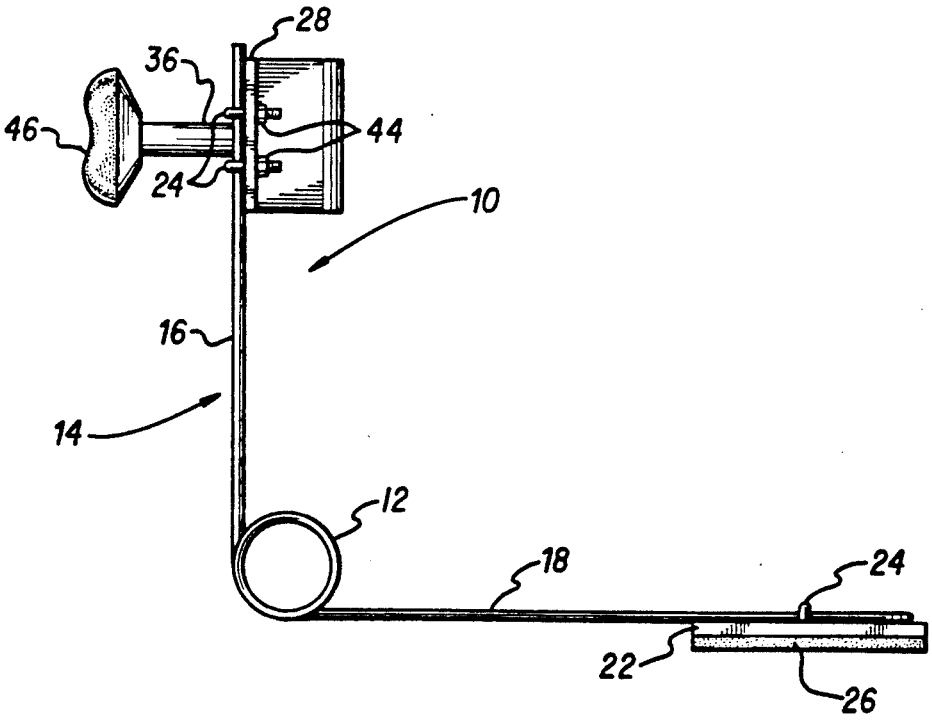
FIG. 4 is a side view of a second embodiment of the abdominal exercise device showing the provision of leg padding and the substitution of padding for the handles of the first embodiment.

In FIG. 4, handles 36 may be covered over with or replaced by padding 46, whereby the user may engage padding 46 by his or her chest or shoulders in the region of the capsular ligaments.

Figure 5:
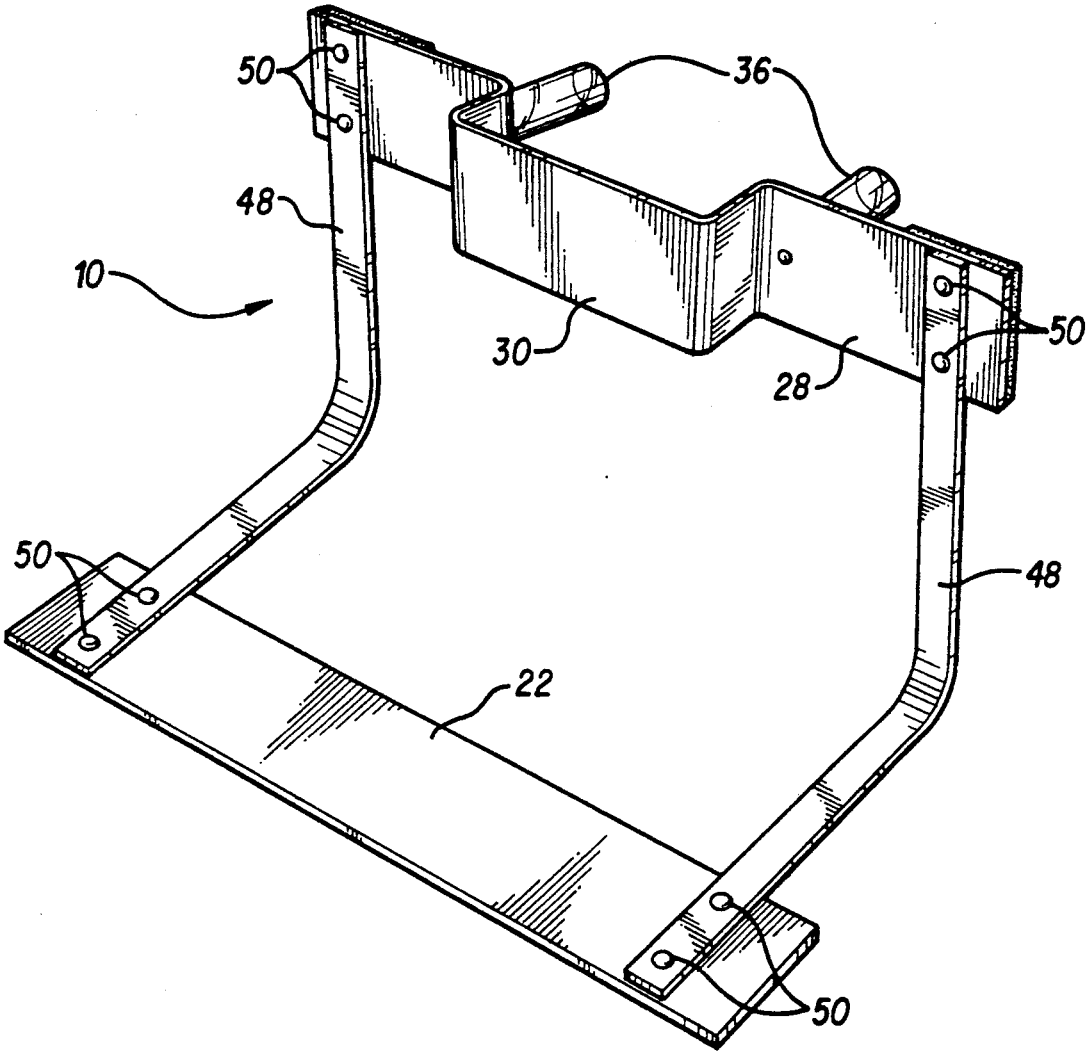
FIG. 5 is a perspective view of a third embodiment of the abdominal exercise device with flat spring steel substituted for the torsion springs of the first embodiment.

FIG. 5 shows a modification of the spring resistance used, wherein resilient bars 48 of spring steel are substituted for the spring stock material 14 forming torsion springs 12. Bars 48 are attached to board 22 and bar 28 by rivets 50.

Figure 6:
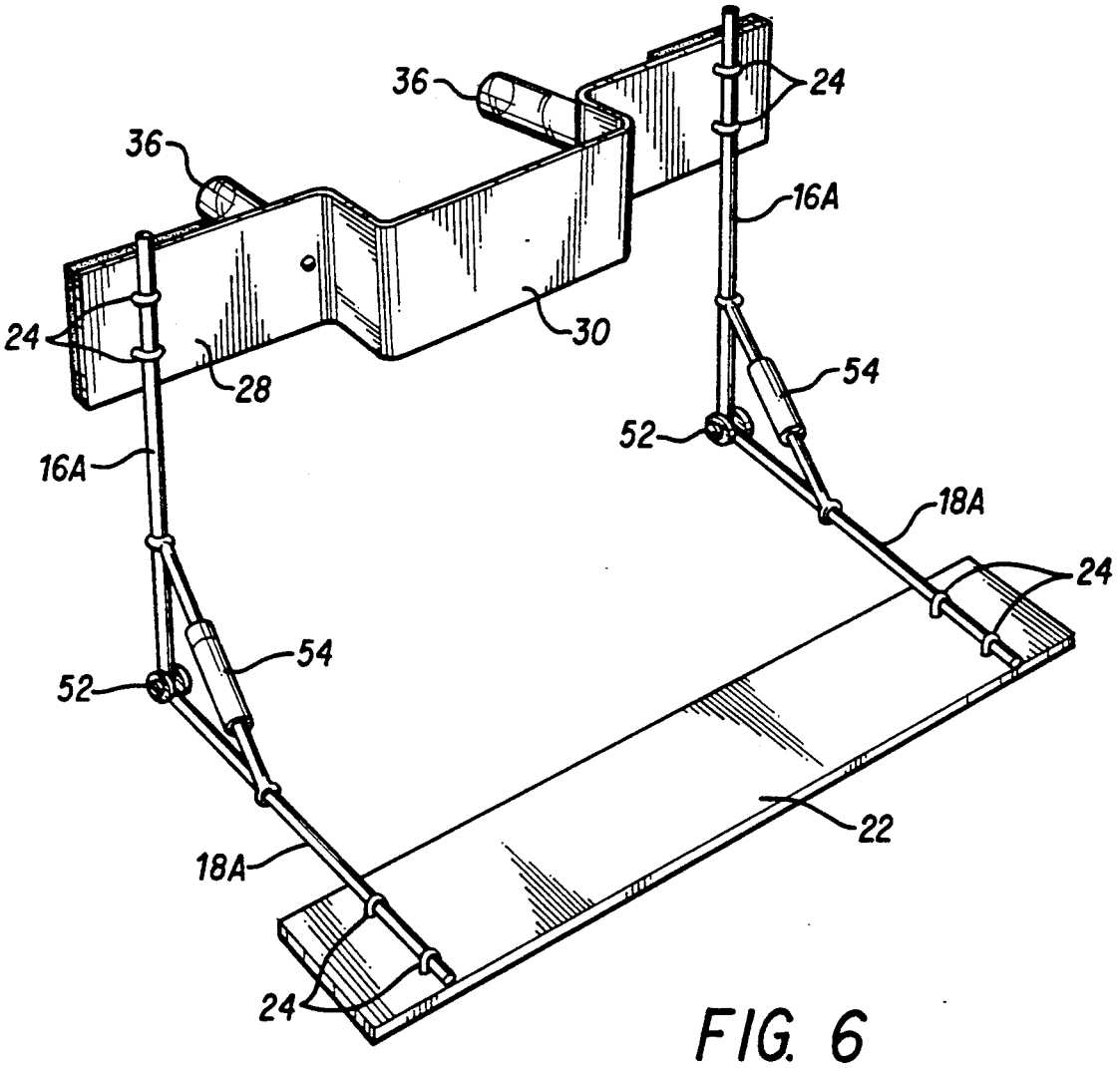
FIG. 6 is a perspective view of a fourth embodiment of the abdominal exercise device with pivots and pneumatic or fluid filled cylinders substituted for the torsion springs of the first embodiment.

In the embodiment shown in FIG. 6, vertical legs 16A and horizontal legs 18A are connected at pivots 52. Resistance is provided by a pair of hydraulic cylinders 54 which may be pneumatic or oil filled.

Figure 7:
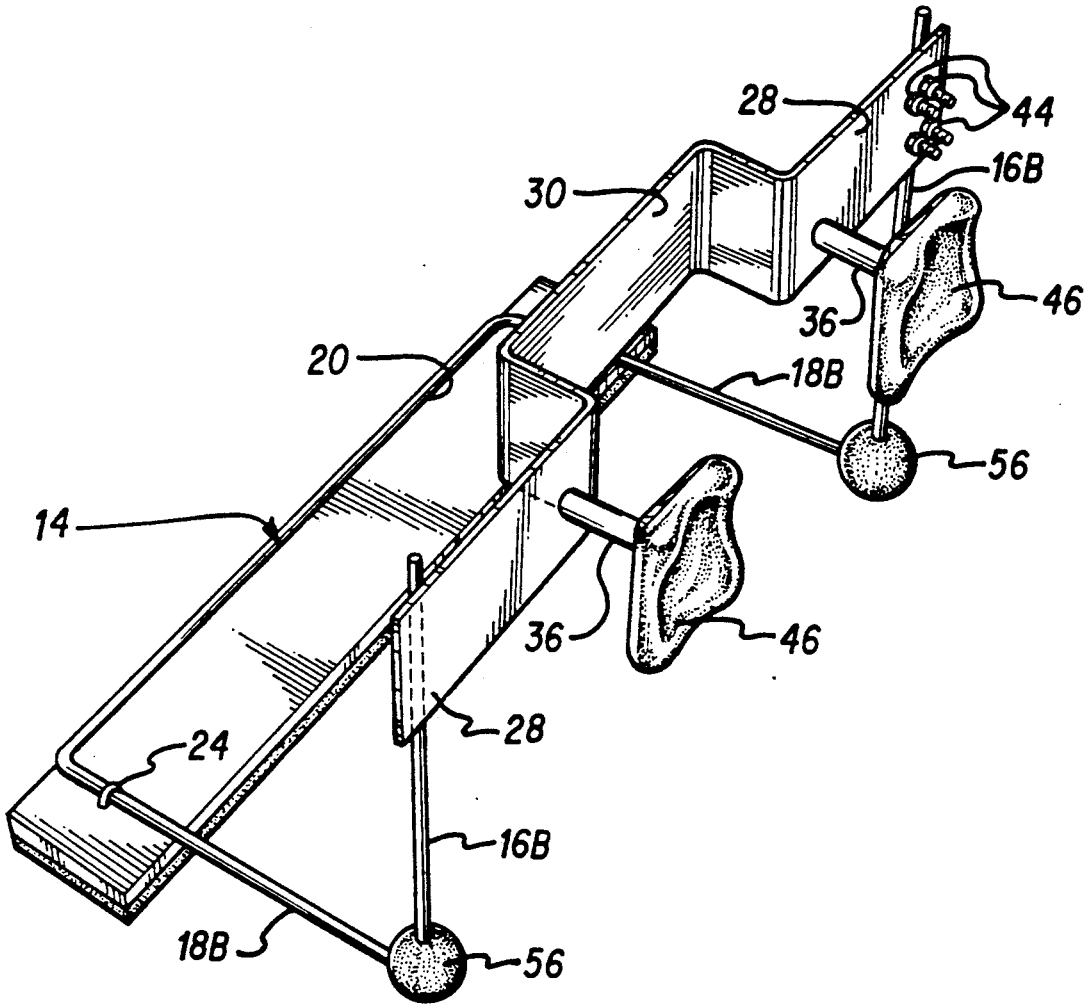
FIG. 7 is a perspective view of a fifth embodiment of the abdominal exercise device, with padding substituted for the handles, and rubber or other elastomeric material substituted for the torsion springs of the first embodiment.

FIG. 7 shows another structural arrangement for providing resistance which includes substituting rubber or other resilient material 56 for the torsion springs 12 at the intersection of the vertical and horizontal legs 16B, 18B.

Figure 8:
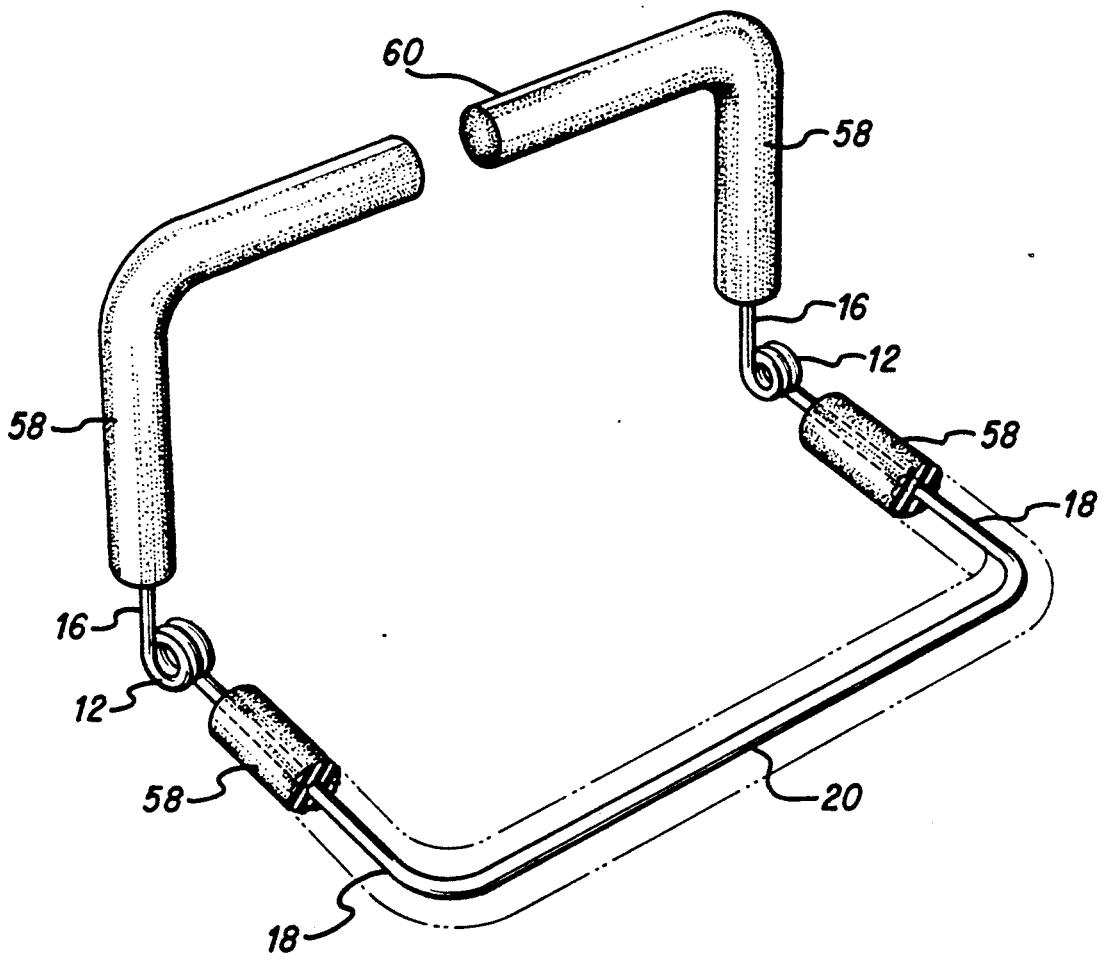
FIG. 8 is a perspective view of a sixth embodiment of the abdominal exercise device, with torsion springs encased in molded foam rubber padding and the transverse bar and horizontal leg board omitted.

In FIG. 8, vertical legs 16, horizontal legs 18 and integral connecting portion 20 of torsion springs 12 are encased in insert molded foam rubber padding 58. The vertical legs 16 are bent towards each other to form handles 60. In this embodiment, the transverse bar 28 and the leg engaging board 22 of FIG. 1 are omitted.

Figure 9:
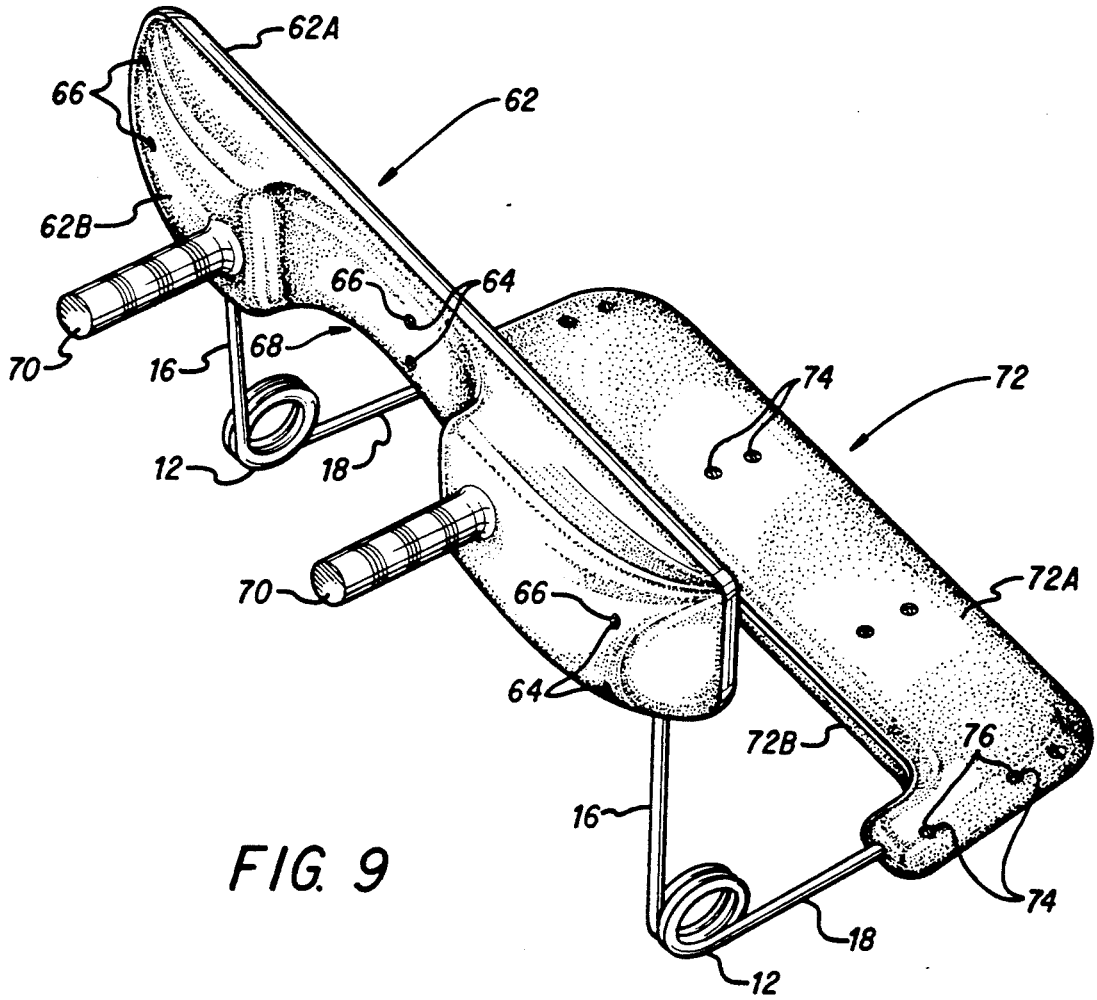
FIG. 9 is a rear perspective view of the preferred embodiment having longitudinal halves of the transverse bar and horizontal leg board joined together in clam shell fashion.
Figure 10:
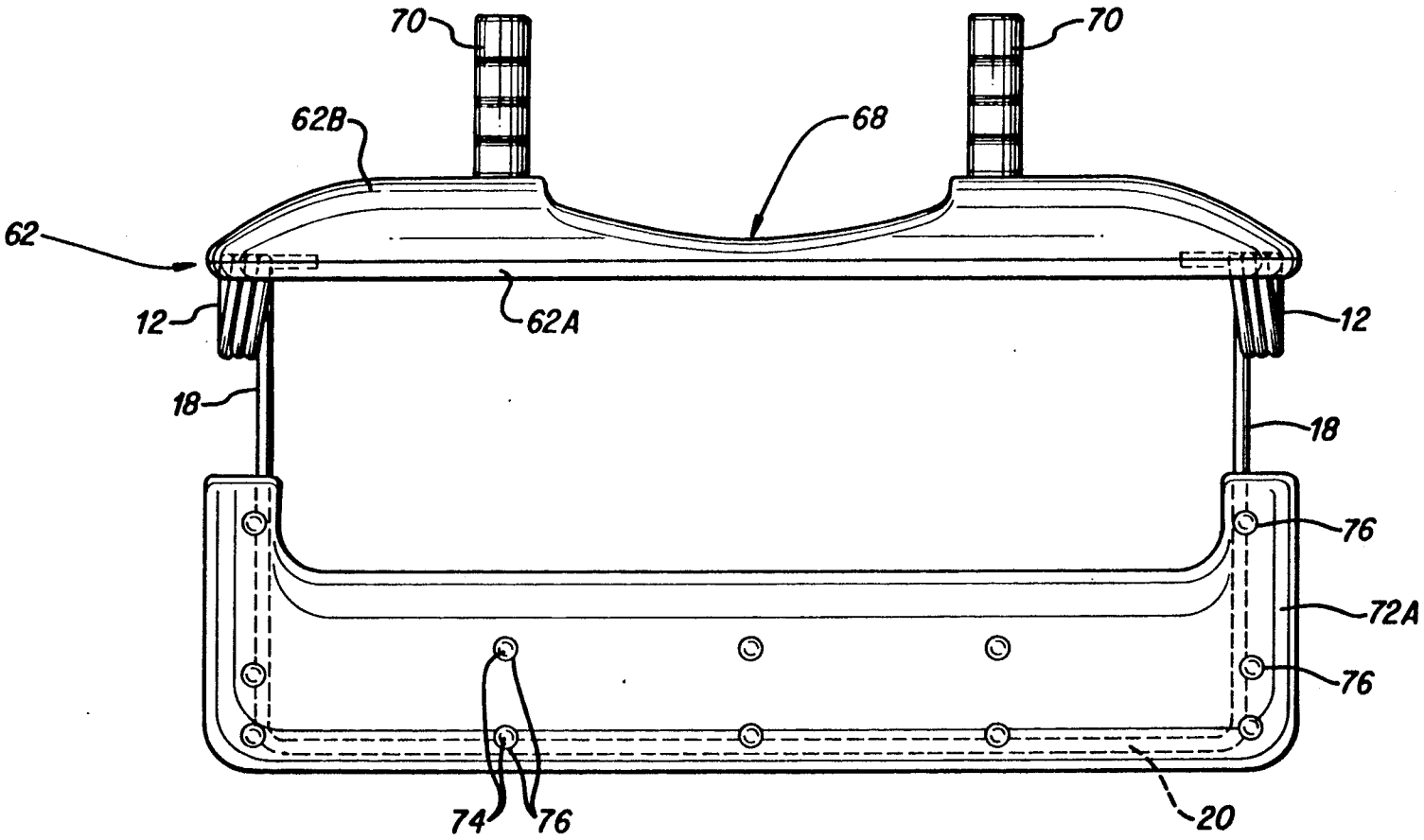
FIG. 10 is a top view of the preferred embodiment.
Figure 11:
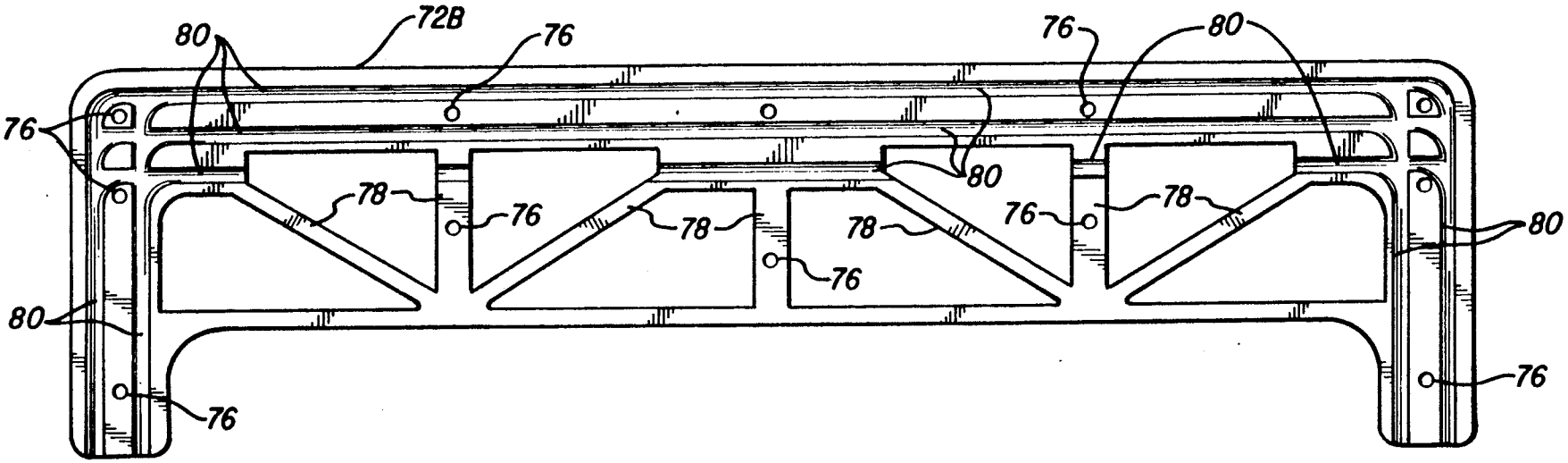
FIG. 11 is a top view of one half of the horizontal leg board of the preferred embodiment, showing the internal arrangement of strengthening ribs, and grooves for receiving the vertical and horizontal torsion spring legs.

The preferred embodiment of this invention is shown in FIGS. 9, 10 and 11. In the preferred embodiment, transverse bar 62 is formed of two longitudinal halves 62A, 62B molded from plastic material and joined together by securing means 64 disposed in recessed bores 66 so as to hold vertical torsion spring legs 16 therebetween in a clam shell-like fashion. The longitudinal rear half 62B of transverse bar 62 has a recessed portion 68 provided for the same reason as recessed portion 30, and a pair of handles 70 integrally molded with longitudinal rear half 62B.

Similarly, leg engaging board 72 is formed of two longitudinal halves 72A, 72B molded from plastic material and joined together by securing means 74 disposed in recessed bores 76 so as to hold horizontal spring legs 18 and integral connecting portion 20 therebetween in a clam shell-like fashion.

Each of the longitudinal halves 62A, 62B, 72A and 72B are provided with strengthening ribs, and also grooves for receiving portions 16, 18 and 20 of torsion springs 12, as shown by way of example only by longitudinal lower half 72B in FIG. 11. In FIG. 11, strengthening ribs are identified by reference numeral 78 and the grooves by reference numeral 80. Recessed bores 76 are also shown in FIG. 6. The positioning of the grooves 80 enables the use of differently sized torsion springs, whereby the resistance of the torsion springs may be varied by the user and/or the manufacturer as desired.

Figure 12:
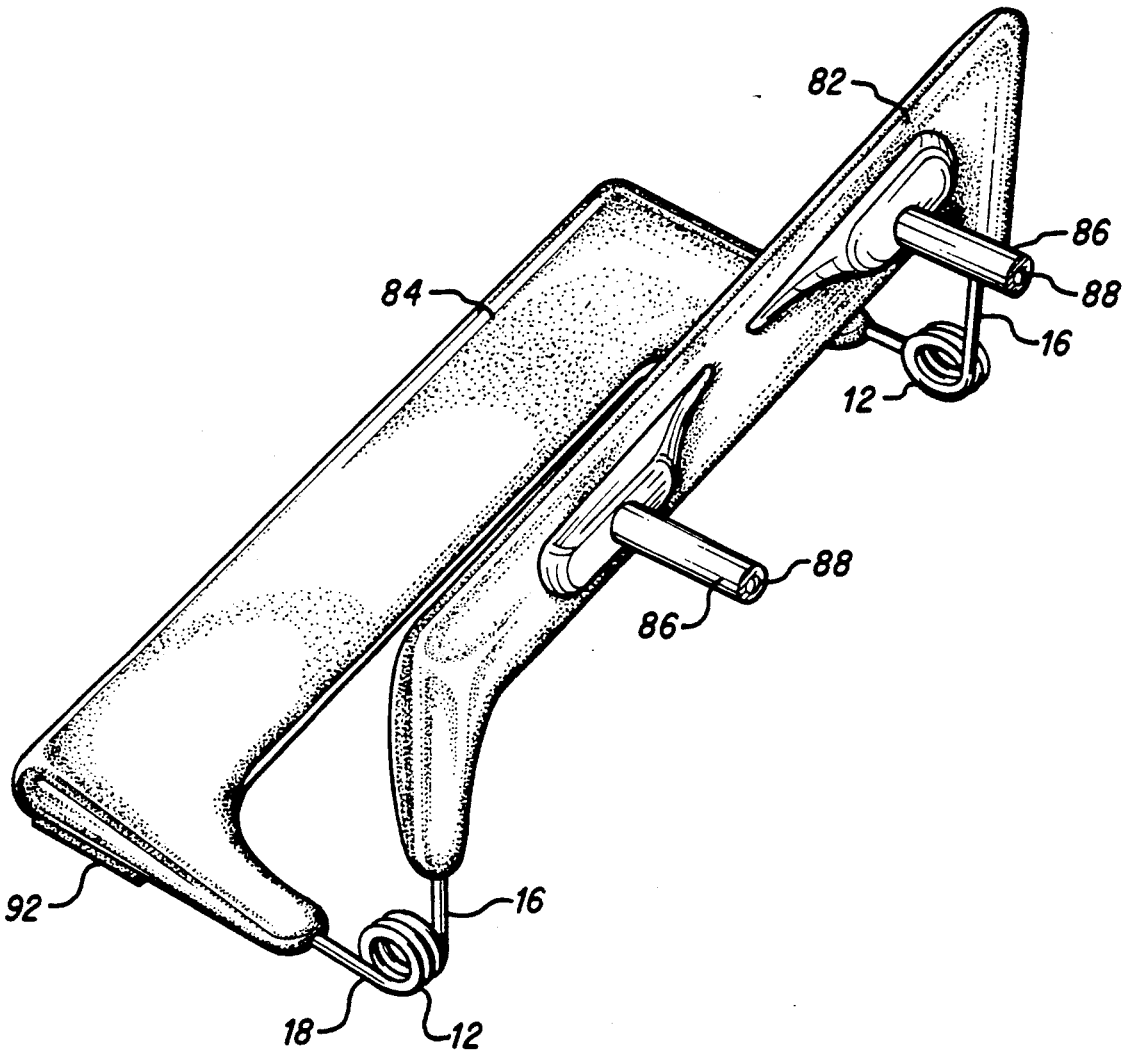
FIG. 12 is a rear perspective view of another embodiment wherein the vertical spring legs and the horizontal spring legs are insert molded into the transverse bar and the horizontal leg board.
Figure 13:
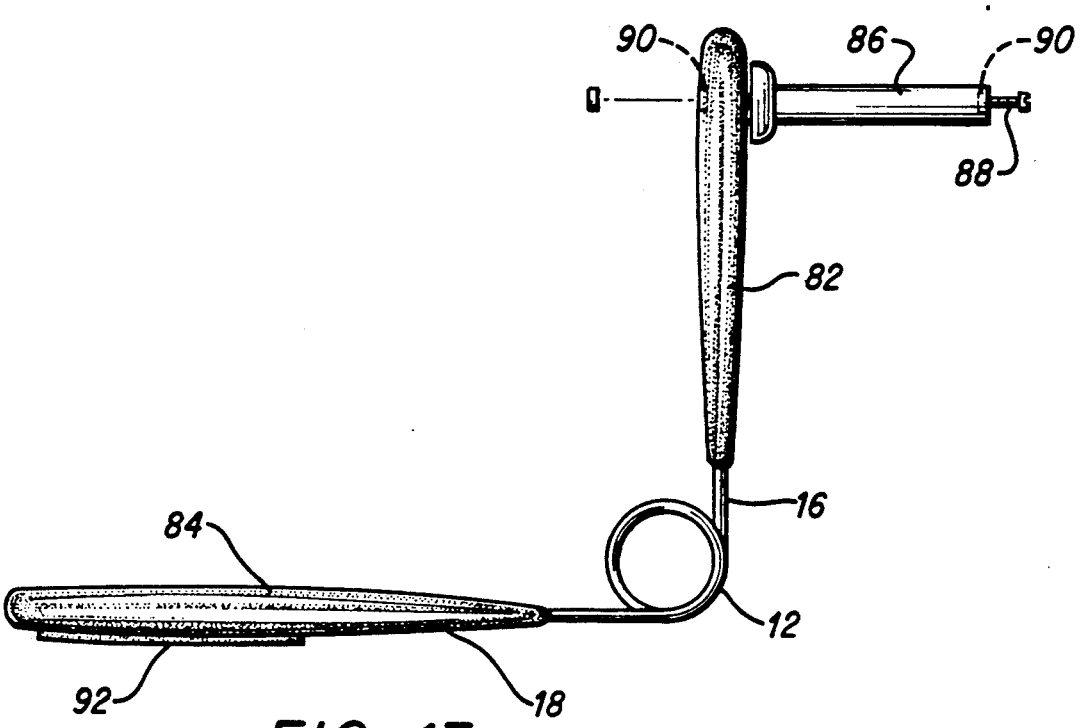
FIG. 13 is a side view of the embodiment of FIG. 12.
Figure 14:
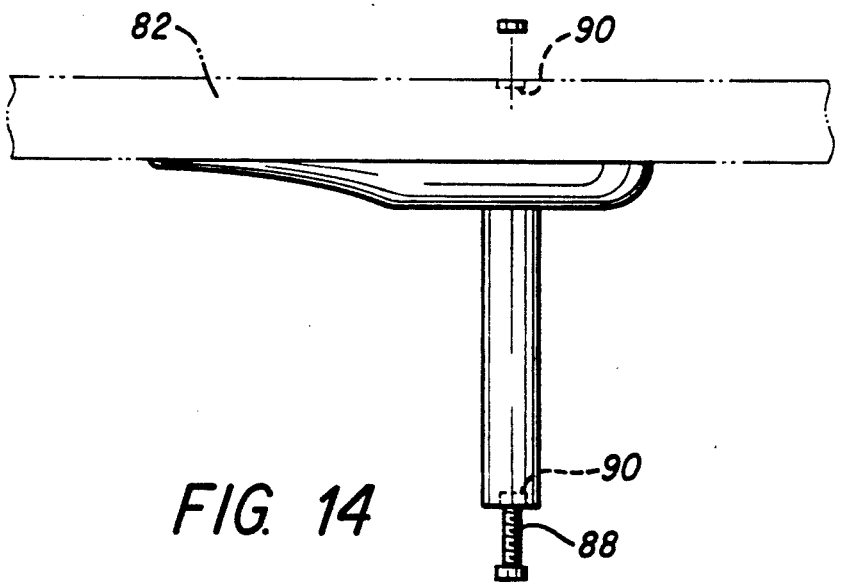
FIG. 14 is a top view of the embodiment of FIG. 12 showing the manner of mounting the handles on the transverse bar.

In the embodiment shown in FIGS. 12, 13 and 14, torsion spring legs 16 and 18, and integral connecting portion 20, are molded into a unitary plastic transverse bar 82 and a unitary plastic leg engaging board 84. Handles 86 are separately molded of plastic material, and are attached to transverse bar 82 by means of bolts 88 and nuts 90 located within recessed bores 90 provided in handles 86 and transverse bar 82. Rubber padding 92 is suitably attached to the bottom of unitary plastic leg engaging board 84.

By pushing transverse bars 28, 62 and 82, and handles 60 towards leg engaging boards 22, 72, 84 and foam rubber covered portion 20, respectively the abdominal muscles may be exercised. Alternatively, the legs may be pulled up towards the chest. In either case the resistance encountered exercises the muscles found in the abdomen and torso area. The device may also be used to exercise other muscles such as the arm and leg muscles. Because the device is portable it can be used at any time and at any location.

While it will be apparent that the preferred embodiments of the invention herein disclosed are well calculated to fulfill the objects above-stated, it will be appreciated that the invention is susceptible to modification, variation and change without departing from the proper scope or fair meaning of the subjoined claims.

I claim:

1. A portable exercise device comprising:

a first upper leg and a first lower leg connected by a first resilient means at the intersection of said first upper and lower legs so as to resiliently maintain said first upper and lower legs at a desired acute angle relative to one another;

a second upper leg and a second lower leg connected by a second resilient means at the intersection of said second upper and lower legs so as to resiliently maintain said second upper and lower legs at said desired acute angle relative to one another, said second upper and lower legs being spaced from said first upper and lower legs;

longitudinal means for connecting said first and second lower legs whereby said portable exercise device may rest on a user's upper legs; and first and second handles connected to said first and second upper legs, respectively; whereby when said handles are engaged by a user's hands and pressure is applied to collapse said first and second upper legs and said first and second lower legs respectively towards one another against the resistance of said first and second resilient means, selected muscles of the user are exercised.

2. A portable exercise device comprising:

a first upper leg and a first lower leg connected by a first resilient means at the intersection of said first upper and lower legs so as to resiliently maintain said first upper and lower legs at a desired acute angle relative to one another;

a second upper leg and a second lower leg connected by a second resilient means at the intersection of said second upper and lower legs so as to resiliently maintain said second upper and lower legs at said desired acute angle relative to one another, said second upper and lower legs being spaced from said first upper and lower legs;

said first and second lower legs being connected by first connecting means to a transverse board arranged to rest on a user's upper legs when said user is seated;

said first and second upper legs being connected by second connecting means to a transverse bar, said transverse bar having engageable means thereon engageable by said user when said user is seated; whereby when said engageable means is engaged by said user's hands and pressure is applied to collapse said first and second upper legs and said first and second lower legs towards one another against the resistance of said first and second resilient means selected muscles of the user are exercised.

3. A portable exercise device as in claim 2, wherein said acute angle is substantially 90 degrees.

4. A portable exercise device as in claim 2, wherein said first and second resilient means comprises first and second torsion springs integrally formed from spring steel.

5. A portable exercise device as in claim 2, wherein said first and second resilient means comprises resilient, yieldable, rubberlike material.

6. A portable exercise device as in claim 2, wherein said first upper and lower legs and said second upper and lower legs each comprise a flat bar formed of spring steel, and said first and second resilient means comprises the spring steel forming the apex of said acute angle.

7. A portable exercise device as in claim 2, further including padding provided on said transverse board to ease the engagement between said transverse board and said users legs.

8. A portable exercise device as in claim 2, said engageable means on said transverse bar comprises handles.

9. A portable exercise device as in claim 2, said engageable means on said transverse bar comprises padding engageable by an upper torso of said user.

10. A portable exercise device as in claim 2, further including a belt means suitably connected to said portable exercise device, whereby said portable exercise device may be attached to said user so as to be retained in position for use.

11. A portable exercise device as in claim 2, wherein said first and second connecting means comprise U-clips, and the muscles exercised include those found in the abdomen and the torso.

12. A portable exercise device as in claim 2, wherein said first and second connecting means comprise rivets, and the muscles exercised include those found in the abdomen and the torso.

13. A portable exercise device as in claim 2, further including a cover means for covering at least one of said first and second resilient means.

14. A portable exercise device as in claim 2, further including cover means for at least one of said first and second torsion springs.

15. A portable exercise device as in claim 2, said transverse bar having a centrally located recessed portion to provide space enabling said user to apply pressure to said transverse bar without engaging said centrally located recessed portion.

16. A portable exercise device as in claim 1, wherein said first and second resilient means are torsion springs;

said first and second upper and lower legs are integral with said first and second resilient means, respectively;

said longitudinal means is integral with said first and second lower legs;

said first and second handles are integral with said first and second upper legs, respectively; and foam rubber padding provided on said first and second upper and lower legs, said longitudinal means and said first and second handles.

17. A portable exercise device as in claim 1, wherein:

said first and second handles are molded integrally with a longitudinal rear half of a transverse bar formed of plastic, said longitudinal rear half of said transverse bar including a centrally located recessed portion;

said transverse bar further including a molded longitudinal front half formed of plastic;

said longitudinal rear half and longitudinal front half being joined together in clam shell fashion by first securing means so as to clamp said first and second upper legs therebetween, said first securing means being located in recessed bores in said front and rear halves; and a leg engaging board including a molded longitudinal upper half and a molded longitudinal lower half formed of plastic and joined together in clam shell fashion by second securing means so as to clamp said first and second lower legs and said longitudinal means for connecting said first and second lower legs therebetween, said second securing means being located in recessed bores in said upper and lower halves.

18. A portable exercise device as in claim 17, wherein:

said longitudinal front half, longitudinal rear half, longitudinal upper half and longitudinal lower half each have internal strengthening ribs, and grooves for locating said first and second upper and lower legs and said longitudinal means for connecting said first and second lower legs between said longitudinal front and rear halves and said longitudinal upper and lower halves, respectively.

19. A portable exercise device as in claim 2, wherein:

said transverse board includes a molded plastic longitudinal upper half and a molded plastic longitudinal lower half joined together in clam shell fashion by first securing means to clamp said first and second lower legs therebetween;

said transverse bar includes a molded plastic longitudinal rear half and a molded plastic longitudinal front half joined together in clam shell fashion to clamp the first and second upper legs therebetween; and said engageable means comprises handles integrally molded with said longitudinal rear half of said transverse bar.

20. A portable exercise device as in claim 19, wherein:

said longitudinal front half, longitudinal rear half, longitudinal upper half and longitudinal lower half each have internal strengthening ribs, and grooves for locating said first and second upper and lower legs and longitudinal means for connecting said first and second lower legs between said longitudinal front and rear halves and said longitudinal upper and lower halves, respectively.

21. A portable exercise device as in claim 1, further comprising:

a molded plastic transverse bar having said first and second upper legs embedded therein;

said handles being connected to said first and second upper legs through connection to said molded plastic transverse bar, said handles being connected by securing means located in recessed bores in said molded plastic transverse bar and in said handles;

said longitudinal means comprising a molded plastic leg engaging board having said first and second lower legs embedded therein; and a resilient pad mounted on a lower surface of said leg engaging board.

22. A portable exercise device as in claim 2, wherein:

said transverse board comprising a unitary molded plastic board having said first and second lower leg embedded therein;

said transverse board being provided with a resilient pad on a lower surface thereof;

said transverse bar comprises a unitary molded plastic bar having said first and second upper legs embedded therein; and said engageable means comprising first and second molded plastic handles secured to said unitary molded plastic bar by securing means located in recessed bores in said handles and said unitary molded plastic bar.

* * * * *